United States Patent [19]

Agee et al.

[11] 4,240,902

[45] Dec. 23, 1980

[54] APPARATUS FOR REMOVING FOREIGN MATTER FROM COTTON

[76] Inventors: John H. Agee, R.R. 2, Woodcliff, Fremont, Nebr. 68025; Richard W. Norris, Jr., Star Rt. C, Box 398, Hobbs, N. Mex. 88240

[21] Appl. No.: 961,040

[22] Filed: Nov. 16, 1978

[51] Int. Cl.[3] ..... B07B 1/15

[52] U.S. Cl. ..... 209/241; 209/247; 209/261; 209/667; 209/671

[58] Field of Search ..... 209/241, 247, 261, 263, 209/392, 350, 351, 314, 361, 671-672, 632, 667, 669, 914

[56] References Cited

U.S. PATENT DOCUMENTS

| | | | |
|---|---|---|---|
| 1,526,394 | 2/1925 | Streun | 209/247 |
| 1,918,774 | 7/1933 | Murray | 209/247 |
| 2,997,086 | 8/1961 | Armer | 209/669 |
| 3,117,671 | 1/1964 | Pearce et al. | 209/671 |
| 3,429,440 | 2/1969 | Hill et al. | 209/241 |

FOREIGN PATENT DOCUMENTS

| | | | |
|---|---|---|---|
| 2259810 | 7/1973 | Fed. Rep. of Germany | 209/671 |

*Primary Examiner*—William A. Cuchlinski, Jr.
*Attorney, Agent, or Firm*—Zarley, McKee, Thomte, Voorhees & Sease

[57] ABSTRACT

An apparatus for removing foreign matter from cotton includes an elongated frame having a plurality of rollers rotatably supported in closely spaced side-by-side relation therealong for conveying cotton over the rollers from one end of the frame to the other in response to rotation of the rollers in unison. The rollers have a plurality of protrusions so that the cotton is vertically shaken as it is conveyed over the rollers with the result that foreign matter falls between the rollers away from the cotton. The protrusions may be the transversely extended corners of polygonal shaped rollers, the corners being adapted to strike the cotton in response to rotation of the rollers for a more vigorous shaking action. A plate may be supported in vertically spaced relation above the rollers for rebounding cotton which is thrown up by the rollers back toward the rollers. A conveyor belt below the rollers collects the foreign matter which drops therethrough.

13 Claims, 8 Drawing Figures

APPARATUS FOR REMOVING FOREIGN MATTER FROM COTTON

BACKGROUND OF THE INVENTION

This invention is directed generally to an apparatus for removing foreign matter from cotton and more particularly to a roller-type conveyor adapted to shake the cotton which is conveyed thereon so that foreign matter is dropped between the rollers and thereby separated from the cotton.

When cotton is harvested in the field, it is customarily collected in large rectangular stacks, ricks or modules which remain on the ground until the cotton is to be processed or ginned. Sand, dirt and other foreign matter tends to accumulate in the stacks both due to such foreign matter being blown against the stacks by the wind and also due to the fact that the stacks are resting on the ground. A problem arises in separating the sand and other foreign matter from the cotton during processing.

Accordingly, it is a primary object of the invention to provide an apparatus for removing foreign matter from cotton.

A further object is to provide an apparatus adapted to vigorously shake the cotton to effect a separation of the foreign matter therefrom.

A further object is to provide such an apparatus in the form of a roller-type conveyor which may be interposed between a usual cotton supply conveyor and the intake opening of a cotton gin or which may alternately be adapted to field use.

A further object is to provide an apparatus in the form of a roller-type conveyor wherein the rollers have a plurality of protrusions thereon so that cotton conveyed on the rollers is shaken to drop foreign matter between the rollers and away from the cotton.

A further object is to provide such an apparatus wherein the rollers have transversely extended corners adapted to strike the cotton in response to rotation of the rollers.

Finally, it is an object of the invention to provide an apparatus for removing foreign matter from cotton which is simple in construction, durable in use and efficient in operation.

SUMMARY OF THE INVENTION

The apparatus of this invention removes sand and other foreign matter from cotton prior to delivery of the cotton into a cotton gin. The apparatus includes an elongated frame on which a plurality of rollers are rotatably supported in closely spaced relation for conveying cotton from one end of the frame to the other. A drive mechanism is provided for rotating the rollers in unison. The rollers are provided with a plurality of protrusions which vibrate or beat the cotton in response to rotation of the rollers. The cotton is thus shaken with the result that foreign matter falls between the rollers and away from the cotton.

The rollers may have a cross-sectional shape in the form of a polygon such as a square, with the corners of the square being the protrusions which strike the cotton conveyed on the rollers. A plate may be secured in vertically spaced relation above the rollers for rebounding back toward the rollers any cotton which is thrown up therefrom, all for a more vigorous shaking of the cotton and more thorough separation of foreign matter.

A conveyor belt is provided below the rollers for simultaneously collecting and removing the foreign matter which drops through the rollers. The lower conveyor may be advantageously driven by one of the rollers so that a single power source may drive both the rollers and lower conveyor.

By interposing the apparatus of the present invention between a usual cotton supply conveyor and the intake opening of a cotton gin, foreign matter may be removed from the cotton without interfering with or slowing down the advancement of cotton into the cotton gin.

DESCRIPTION OF THE PREFERRED EMBODIMENT

Figure 1:
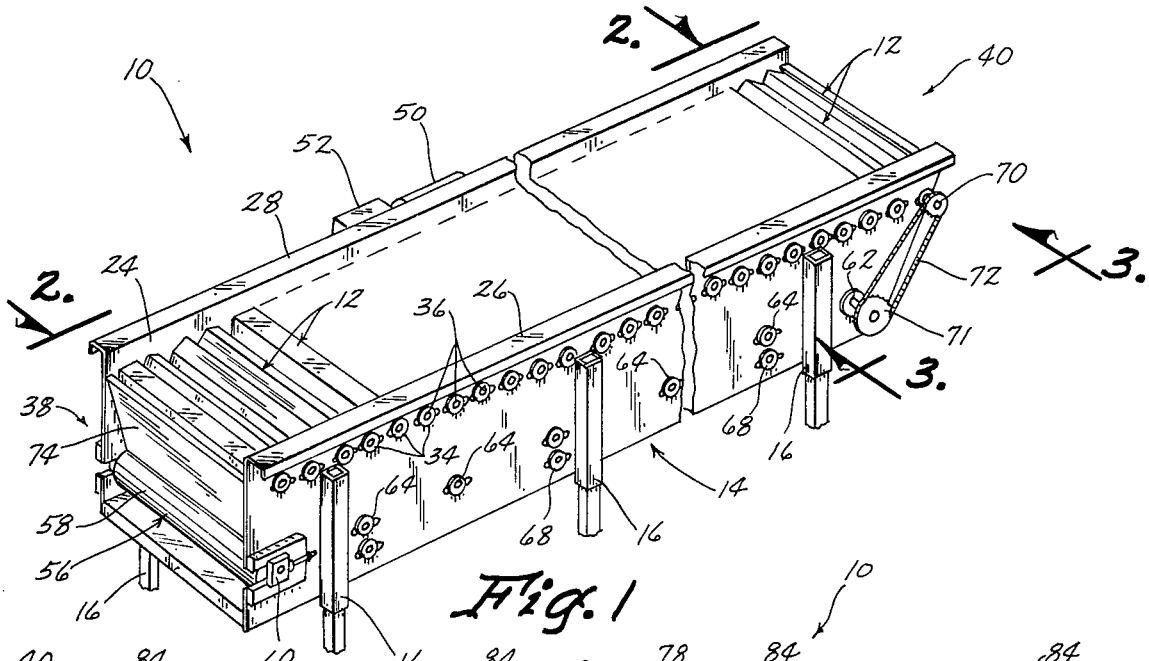
FIG. 1 is a perspective view of the apparatus of the invention.

The apparatus of the present invention for removing sand and other foreign matter from cotton is indicated generally at 10 in FIG. 1. The apparatus includes a plurality of rollers 12 which are rotatably supported in closely spaced relation along the length of a support frame, indicated generally at 14, for conveying cotton from one end of the frame to the other and simultaneously separating foreign matter therefrom.

Figure 4:
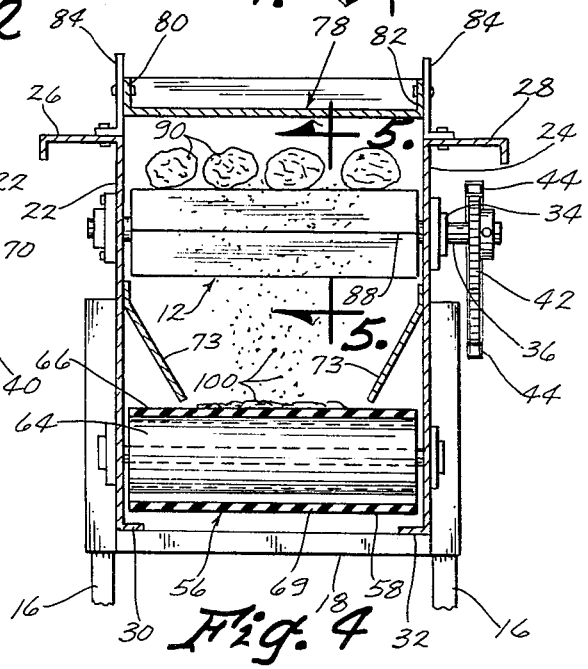
FIG. 4 is an end sectional view of the apparatus, taken along line 4—4 in FIG. 2.

Support frame 14 includes a plurality of upright leg members 16 (FIG. 1) which are interconnected both by transversely extended frame cross-members 18 (FIG. 4) and a plurality of inclined gussets 20 (FIG. 2) extending from a leg member on one side of the frame to a leg member on the opposite side of the frame. A pair of transversely spaced upstanding side panels 22 and 24 are secured to the leg members 16. In FIG. 4, it can be seen that the side panels 22 and 24 each have outwardly extended upper flanges 26 and 28 and inwardly extended lower flanges 30 and 32.

Referring to FIG. 1, the side panels 22 and 24 have a plurality of transversely aligned pairs of bearing openings arranged in longitudinally spaced apart relation along upper portions thereof. There is secured in each of the bearing openings a bearing 34 adapted to rotatably receive one end of a roller shaft 36. The rollers 12 are thus supported transversely of the frame 14 and arranged in closely spaced relation for conveying cotton on the rollers from one end 38 of frame 14 to the opposite end 40.

Figure 2:
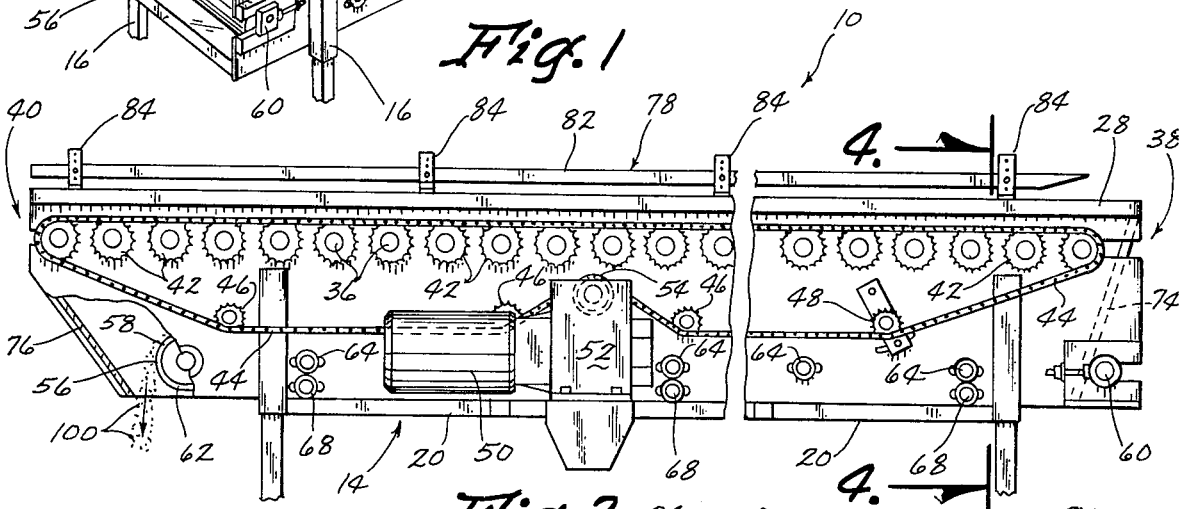
FIG. 2 is an enlarged side view of the apparatus as seen on line 2—2 in FIG. 1 with the addition of a generally horizontal plate secured above the rollers.

To rotate the rollers 12 in unison, a sprocket 42 is secured onto the end of each roller shaft 36 outwardly of side panel 24 as shown in FIGS. 2 and 4. A chain 44 is drawn in driving engagement over each of the sprockets 42 as well as three idler sprockets 46 and a tension adjustment sprocket 48. An electric motor 50 which is secured on side panel 24 is connected through an appropriate speed reduction gearbox 52 to a drive sprocket 54 which is disposed in driving engagement with the chain 44.

Chain 44 not only drives the rollers 12 but also serves to maintain the rollers in fixed rotational relation to one another. It can be seen that in the preferred form of FIG. 5, each roller is rotatably offset 15° relative to each of the adjacent rollers. The roller relationship may alternatively be of any increment of degrees.

A belt conveyor, indicated generally at 56, is supported between side panels 22 and 24 and spaced vertically below the rollers 12 for collecting foreign matter which drops between the rollers as cotton is conveyed over them. Belt conveyor 56 includes a woven belt 58 (FIG. 6) which is drawn around a tension adjustment roller 60 at the intake end 38 of the frame and a fixed roller 62 at the discharge end 40 of the frame. A plurality of support rollers 64 are secured between side panels 22 and 24 for supporting the underside of the upper run 66 of belt 58 while several guide rollers 68 engage the upper surface of lower run 69 to maintain the upper and lower runs in vertically spaced relation.

Figure 3:
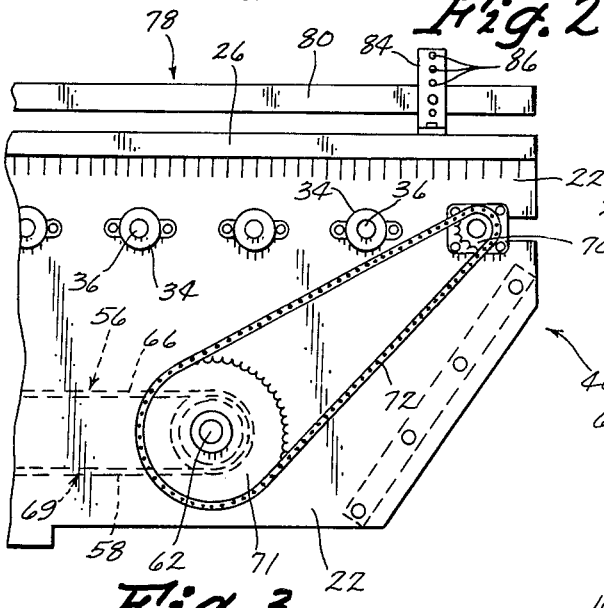
FIG. 3 is an enlarged detail side view showing the drive connection between one roller and the lower conveyor as seen on line 3—3 of FIG. 1.

In FIGS. 1 and 3, it is seen that the endmost roller 12 adjacent the discharge end 40 of the frame is provided with a sprocket 70 on the end of its associated roller shaft on the side of side panel 22. Another sprocket 71 is secured onto the same end of fixed roller 62 and a chain 72 is secured about both sprockets to drive the belt conveyor 56 in response to rotation of the endmost roller 12. Sprocket 71 may be interchanged with smaller or larger sprockets in order to vary the speed of belt conveyor 56 although the specific sprocket 71 which is shown provides for a conveyor speed of approximately one-fourth the speed of advancement of cotton along the rollers 12.

In order to direct foreign matter onto the conveyor belt 58 as it falls through the rollers 12, each side panel 22 and 24 is provided with an elongated inwardly and downwardly extended flange 73 (FIG. 4) which runs substantially the length of the frame 14. In addition, a front deflector plate 74 (FIGS. 1 and 2) closes the intake end 38 of the frame 14 for directing foreign matter onto conveyor belt 58. A rear deflector plate 76 closes the discharge end 40 of frame 14 and guides the foreign matter collected by belt 58 downwardly into a suitable refuse container (not shown).

A horizontal deflector plate 78 is supported in vertically spaced relation above the rollers 12 for limiting upward vertical movement of cotton as it is conveyed along the rollers. Deflector plate 78 has upstanding side flanges 80 and 82 which engage support brackets 84 that are supported on the side panel flanges 26 and 28. Brackets 84 have a plurality of vertically spaced holes 86 to provide for vertical adjustment of plate 78 within a range of approximately two to six inches above the rollers 12. The forward end 87 of plate 78 is inclined upwardly to facilitate the entry of cotton into the vertical space between the plate and rollers. Plate 78 also tends to spread the cotton so that it is generally uniformly distributed over the transverse extent between side panels 22 and 24.

Figure 5:
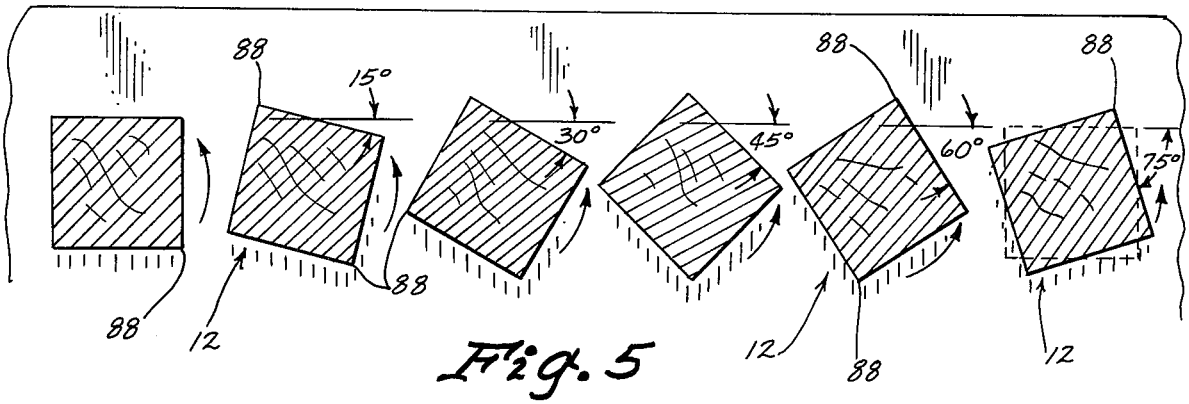
FIG. 5 is an enlarged side sectional view showing the offset relation between adjacent rollers.
Figure 6:
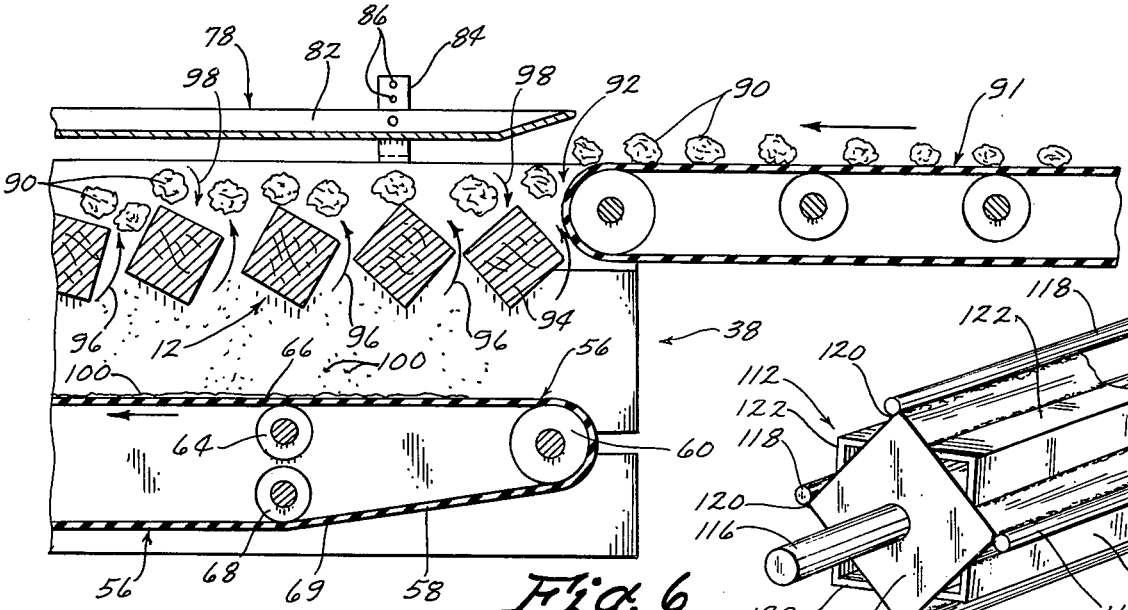
FIG. 6 is an enlarged sectional side view showing one end of the apparatus receiving cotton from a supply conveyor.

The rollers 12 are shown in FIGS. 5 and 6 as having a square cross-sectional shape. As a result, each of the rollers 12 has four transversely extended corners or radial protrusions 88 which tend to beat or vibrate the cotton on the rollers in response to rotation of the rollers. The square cross-sectional shape, however, is not critical to the present invention and it will be apparent that rollers of various other shapes may be provided which have radial protrusions for accomplishing the same purpose of generally vertically shaking the cotton being conveyed on the rollers. Such rollers, in cross-section, may be shaped like an oval or any other polygon wherein the corners between adjacent sides serve as the protrusions for beating the cotton.

In operation, cotton 90 is delivered on a supply conveyor 91, as shown in FIG. 6, to the intake end 38 of frame 14. Supply conveyor 91 is shown as a standard belt conveyor with the discharge end 92 thereof positioned above the endmost roller 94 so that cotton is discharged from conveyor 91 onto roller 94 and the adjacent roller. Conveyor 91 preferably advances cotton toward rollers 12 at the same speed that cotton is advanced on the rollers so that conveyor 91 imparts the initial velocity to the cotton 90 as it is deposited onto the endmost roller 94. All of the rollers 12 are rotated in the direction of arrows 96 in FIG. 6 so that a reverse rotation is imparted to the cotton as indicated by arrows 98 in FIG. 6 as it is conveyed rearwardly over the rollers 12 towards the discharge end 40 of the frame 14. The rotating protrusions 88 on the rollers 12 effect a vigorous shaking of the cotton 90 so that foreign matter, indicated at 100, such as sand, dirt and the like drops between the rollers away from the cottom. The offset relation of adjacent rollers accounts for the alternate widening and narrowing of the gap between adjacent rollers such that small foreign matter is permitted to fall between the rollers while the cotton is conveyed over them. The separated matter is directed by side flanges 72 and front deflector 74 onto belt 58 which conveys the foreign matter rearwardly for discharge between the conveyor and front deflector plate 74 into a suitable refuse container. Any cotton which is thrown upwardly by the rotating protrusions 88 strikes the horizontal deflector plate 78 and is rebounded back toward the rollers for continuous shaking of the cotton material.

In one embodiment of the invention, square rollers having sides four inches wide were arranged on six inch centers and rotated at approximately 204 revolutions per minute to effect a conveying speed of approximately 287 feet per minute, conveying speed being the rate at which cotton is advanced along the apparatus.

Figure 7:
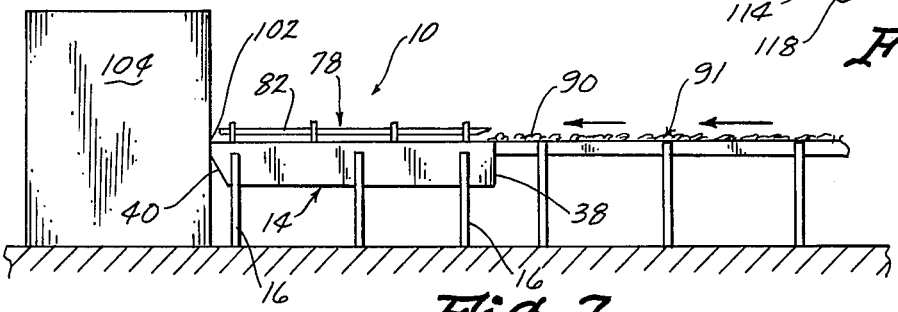
FIG. 7 is a diagrammatic side elevational view showing the apparatus of the invention interposed between a supply conveyor and cotton gin.

Referring to FIG. 7, it is seen that the discharge end 40 of frame 14 is disposed in communication with the intake opening 102 of a cotton gin 104 for the delivery of cotton material from the rollers 12 into the gin. The cotton is generally delivered onto a flat table within a suck tube wherein the good cotton is drawn upwardly into a processing chamber and the heavier green bowls and sticks pass through the suck tube. As a result, the combination of the apparatus of the present invention with a cotton gin provides for a three-way separation of the incoming cotton material. Sand and small foreign matter is separated from the cotton in the apparatus of the present invention whereas the green bowls, sticks and heavy foreign matter are separated from the good cotton in the gin in the usual manner. Since sand and dirt which is dispersed throughout the cotton material would otherwise be drawn into the processing chamber with the good cotton, the apparatus of the present invention performs an additional separating function not otherwise accomplished by conventional cotton gins. By substantially reducing the amount of sand and the like which is introduced into the gin, the required maintenance and servicing of the gin may be reduced. In addition, any remaining sand that is conveyed with the cotton is more effectively removed by present means due to its being vibrated loose or separated.

Figure 8:
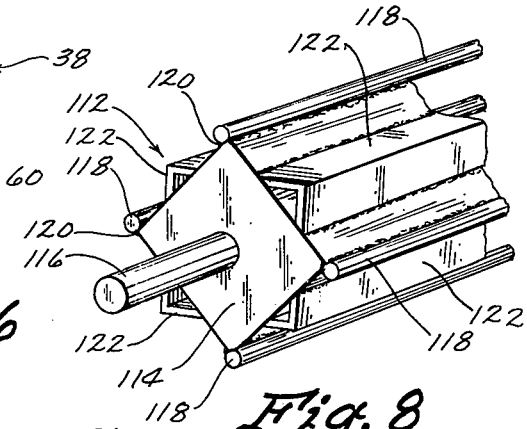
FIG. 8 is a fragmentary perspective view of a modified roller.

A modified form of roller 112 is shown in FIG. 8. Like rollers 12 described above, roller 112 includes a square-section body 114 secured on a central shaft 116. However, roller 112 also includes four round rods 118 secured onto the corners 120 of the roller and angle members 122 secured centrally of each side of the roller and extended across the length of the roller. By substituting rollers 112 for rollers 12, the gap between adjacent rollers is decreased and the rods 118 and angle members 122 intensify the agitation of the cotton. The rollers may alternatively be modified to be of a fabricated or stamped shape and may include more or less protrusions for the desired shaking action.

The apparatus may be so manufactured to be installed in multiples of itself to increase separation as required.

Accordingly, there has been shown and described an apparatus for separating foreign matter from cotton which accomplishes at least all of the stated objects. Although the described apparatus works extremely well to remove foreign material from cotton, the apparatus may also be used to convey materials other than cotton while removing foreign material therefrom.

I claim:

1. In combination with a cotton gin having an intake opening for receiving cotton therein and a conveyor for supplying cotton thereto, the improvement comprising an apparatus for removing foreign matter from the cotton, said apparatus being interposed between said intake opening and conveyor and comprising, an elongated frame means having one end portion disposed in communication with said conveyor for receiving cotton therefrom and an opposite end portion disposed in communication with said intake opening for delivering cotton thereto, a plurality of rollers extended transversely of said frame means, means for rotatably supporting said rollers in side-by-side closely spaced relation on said frame means whereby said rollers cooperatively define a cotton supporting conveyor surface, means for rotating said rollers in unison whereby cotton discharged from said conveyor means onto said one end portion of the frame means is conveyed on said rollers to the opposite end portion of the frame means toward said intake opening, said rollers having a plurality of protrusions thereon whereby said cotton is generally vertically shaken in response to rotation of said rollers, and an elongated plate means disposed generally parallel to and in vertically spaced relation above said rollers at a position for rebounding cotton thrown upwardly by said rollers back to said rollers.

2. The apparatus of claim 1 wherein each roller is rotatably offset less than ninety degrees relative to each adjacent roller.

3. The apparatus of claim 2 wherein said rollers are uniformly rotatably offset between ten and twenty degrees relative to said adjacent rollers.

4. The apparatus of claim 1 wherein said rollers are generally polygonal in cross-section including a plurality of corners extended across said rollers, said protrusions including said corners.

5. The apparatus of claim 4 wherein said protrusions include a plurality of elongated angle members, each including opposite free edges secured to a side of a roller so as to form a supplemental corner thereon.

6. The apparatus of claim 1 further comprising a conveyor belt arranged below said rollers for collecting foreign matter which drops between said rollers.

7. The apparatus of claim 6 wherein said conveyor belt is drivingly connected to one of said rollers for advancement in response to rotation of said one roller.

8. The apparatus of claim 7 further comprising inwardly and downwardly extended flanges on opposite sides of said frame means for directing foreign matter which falls between said rollers onto said conveyor belt.

9. The apparatus of claim 8 wherein said frame means includes a pair of opposite sidewalls having a plurality of transversely aligned pairs of bearing openings therein, said rollers being rotatably supported within said pairs of bearing openings.

10. The apparatus of claim 9 wherein said means for rotating said rollers in unison includes respective sprockets secured onto one end of each of said rollers, and an elongated chain drivingly engaged with each of said sprockets, and power means for advancing said chain relative to said sprockets.

11. In combination with a cotton gin having an intake opening for receiving cotton therein and a conveyor for supplying cotton thereto, the improvement comprising an apparatus for removing foreign matter from the cotton, said apparatus being interposed between said intake opening and conveyor and comprising, an elongated frame means having one end portion disposed in communication with said conveyor for receiving cotton therefrom and an opposite end portion disposed in communication with said intake opening for delivering cotton thereto, a plurality of rollers extended transversely of said frame means, means for rotatably supporting said rollers in side-by-side closely spaced relation on said frame means whereby said rollers cooperatively define a cotton supporting conveyor surface, means for rotating said rollers in unison whereby cotton discharged from said conveyor means onto said one end portion of the frame means is conveyed on said rollers to the opposite end portion of the frame means toward said intake opening, said rollers having a plurality of protrusions thereon whereby said cotton is generally vertically shaken in response to rotation of said rollers, an elongated plate means disposed generally parallel to and in vertically spaced relation above said rollers whereby cotton thrown upwardly by said rollers is rebounded by said plate means back to said rollers, and means for vertically adjusting said plate means relative to said rollers.

12. In combination with a cotton gin having an intake opening for receiving cotton therein and a conveyor for supplying cotton thereto, the improvement comprising an apparatus for removing foreign matter from the cotton, said apparatus being interposed between said intake opening and conveyor and comprising, an elongated frame means having one end portion disposed in communication with said conveyor for receiving cotton therefrom and an opposite end portion disposed in communication with said intake opening for delivering cotton thereto, a plurality of rollers extended transversely of said frame means, means for rotatably supporting said rollers in side-by-side closely spaced relation on said frame means whereby said rollers cooperatively define a cotton supporting conveyor surface, means for rotating said rollers in unison whereby cotton discharged from said conveyor means onto said one end portion of the frame means is conveyed on said rollers to the opposite end portion of the frame means toward said intake opening, said rollers having a plurality of protrusions thereon whereby said cotton is generally vertically shaken in response to rotation of said rollers, an elongated plate means disposed generally parallel to and in vertically spaced relation above said rollers whereby cotton thrown upwardly by said rollers is rebounded by said plate means back to said rollers, and said rollers being generally polygonal in cross-section including a plurality of corners extended across said rollers, said protrusions including said corners, said protrusions including a plurality of elongated angle members, each including opposite free edges secured to a side of a roller so as to form a supplemental corner thereon, and said protrusions including a plurality of elongated rods secured to said corners and arranged parallel to said corners along the length of said rollers.

13. The apparatus of claim 12 wherein said rollers are generally square in cross-section.

* * * * *